US006152342A

United States Patent [19]

Suk

[11] Patent Number: 6,152,342

[45] Date of Patent: Nov. 28, 2000

[54] GOLF BAG WITH DOUBLE STRAP AND BUCKLE

[76] Inventor: Young J. Suk, 270 Glen Cove Ave., Sea Cliff, N.Y. 11579

[21] Appl. No.: 09/118,898

[22] Filed: Jul. 20, 1998

[51] Int. Cl.[7] ..... A45F 3/04

[52] U.S. Cl. ..... 224/645; 224/627; 224/259; 24/315; D3/255

[58] Field of Search ..... 224/153, 578, 224/579, 160, 606, 623, 624, 627, 628, 637, 638, 639, 640, 641, 645, 259, 260, 261, 262; D3/255; 24/315

[56] References Cited

U.S. PATENT DOCUMENTS

| | | | |
|---|---|---|---|
| 117,694 | 8/1871 | Smith | 24/315 |
| D. 387,556 | 12/1997 | Beebe et al. | 224/645 X |
| D. 411,039 | 9/1999 | Reimers et al. | D3/255 |
| 1,570,500 | 1/1926 | Kennedy | 224/627 X |
| 2,853,111 | 9/1958 | Williams | 224/259 |
| 3,739,961 | 6/1973 | Soukeras | 224/627 X |
| 4,936,495 | 6/1990 | Van De Pol | 224/627 |
| 5,205,450 | 4/1993 | Derosier | 224/262 X |
| 5,205,451 | 4/1993 | Manzer | 224/259 X |
| 5,806,742 | 9/1998 | Mott et al. | 224/150 X |
| 5,954,255 | 9/1999 | Beebe et al. | 224/645 |

FOREIGN PATENT DOCUMENTS

| | | | |
|---|---|---|---|
| 70754 | 2/1916 | Germany | 224/210 |
| 75855 | 1/1918 | Norway | 224/209 |
| 248382 | 4/1947 | Norway | 224/209 |

*Primary Examiner*—Gregory M. Vidovich
*Attorney, Agent, or Firm*—Myron Amer PC

[57] ABSTRACT

A two-strap golf bag carrier in which the first and second straps each being oriented in opposite angular directions are adapted to cross each other at approximately a mid-point of the user's back, at which crossing point the straps are joined together which obviates lateral movement of the straps away from each other as would cause a strap to slip off of a shoulder.

1 Claim, 2 Drawing Sheets

FIG. 4
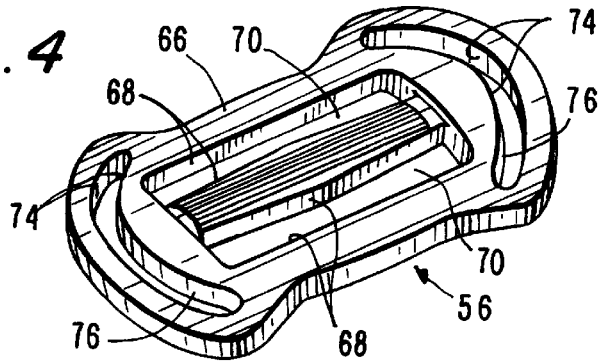
FIG. 5
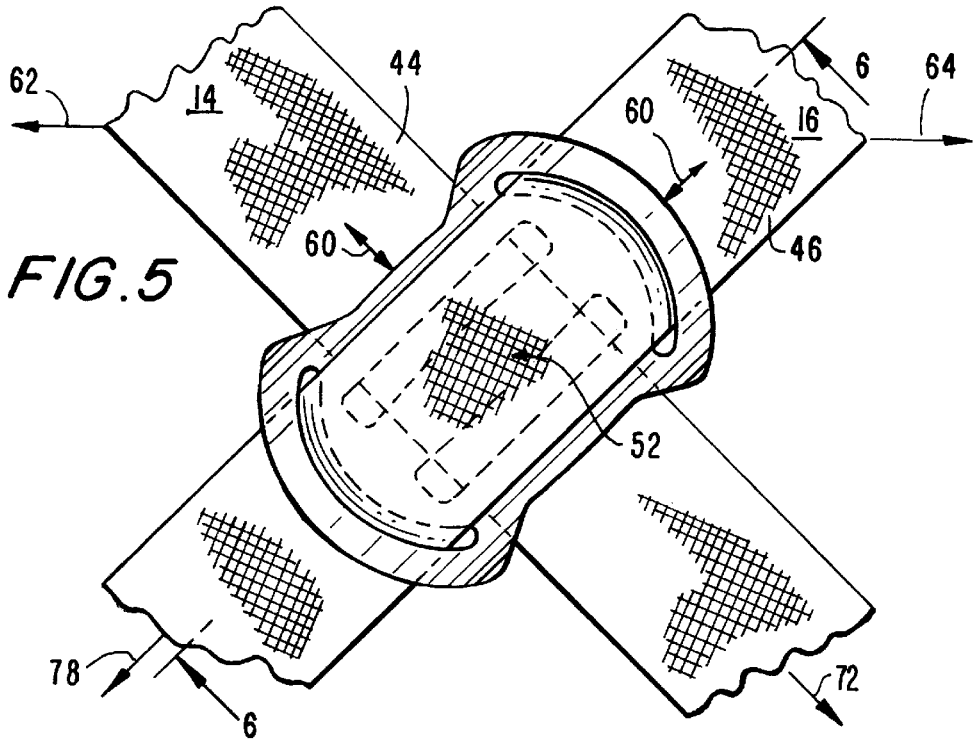
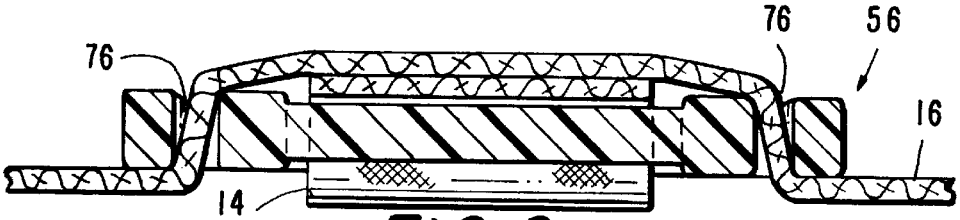
FIG. 6

GOLF BAG WITH DOUBLE STRAP AND BUCKLE

The present invention generally relates to improvements for a two-strap carrier of a golf bag, and more particularly to improvements which are effective to maintain these straps in place over the golfer's shoulders during use.

BACKGROUND OF THE INVENTION

It is already well known, particularly for a female golfer, and as exemplified by U.S. Pat. No. 2,853,111 for "Golf Bag" issued to A. K. Williams on Sep. 23, 1958, that in the carrying of a golf bag filled with golf clubs the weight is better managed using two straps, each looped over the right and the left shoulders of the golfer, rather than using a single strap looped over one shoulder and bearing the full weight of the golf clubs-loaded golf bag. While notable, the '111 patented two-strap carrier when in use exhibits a tendency of a strap slipping off of a shoulder of the golfer.

SUMMARY OF THE INVENTION

Broadly, it is an object of the present invention to provide a two-strap golf bag carrier overcoming the foregoing and other shortcomings of the prior art.

More particularly, it is an object to provide a two-strap carrier in which the two-strap configuration is effectively restrained against slipping off of a cooperating shoulder of the golfer, all as will be better understood as the description proceeds.

BRIEF DESCRIPTION OF THE DRAWING

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figure 1:
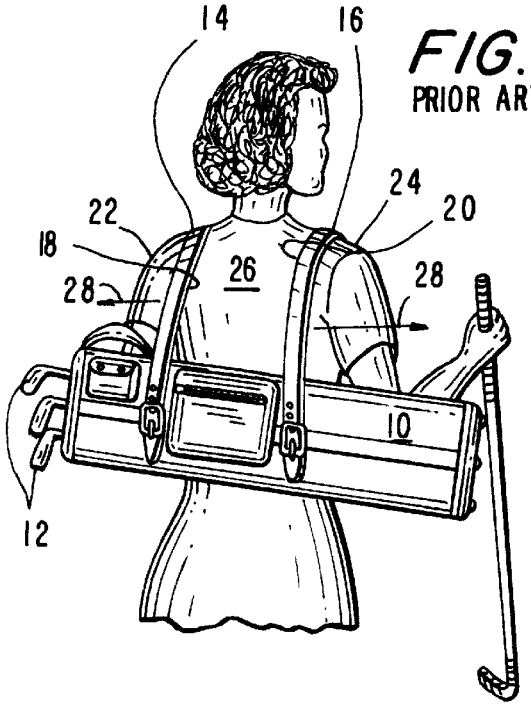
FIG. 1 PRIOR ART
Figure 2:
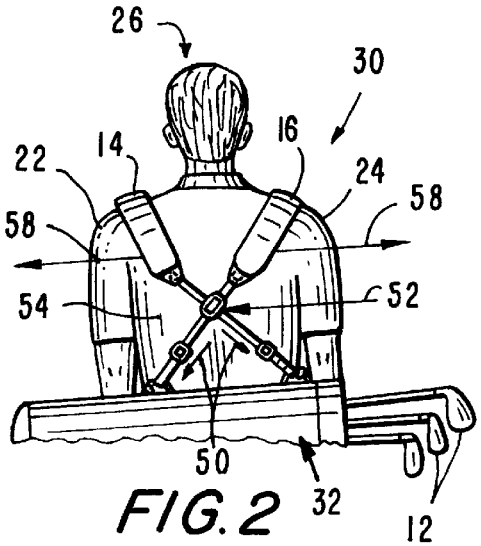
Figure 3:
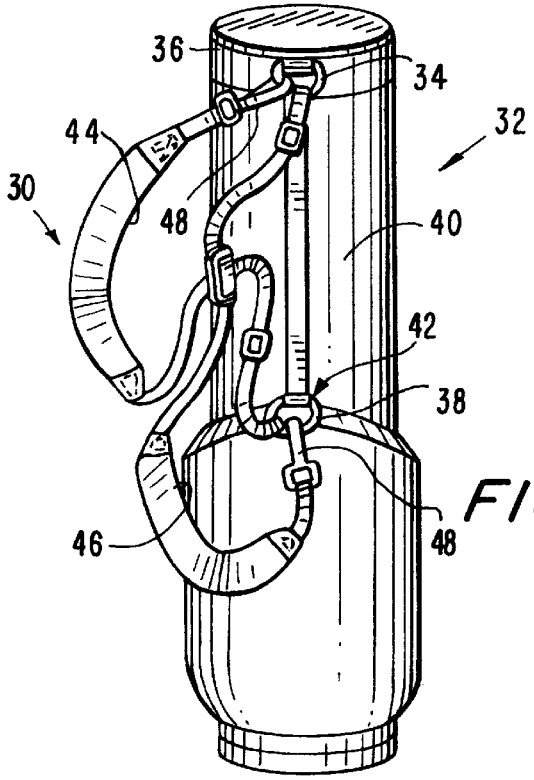

FIG. 1 is a rear perspective view of a golfer using a prior art two-strap golf bag carrier;

FIG. 2 is a similar rear perspective view, but of the within inventive two-strap golf bag carrier;

FIG. 3 is an isolated perspective view of the strap carrier of FIG. 2;

FIG. 4 is an isolated perspective view of a buckle component used in the within inventive two-strap golf bag carrier;

FIG. 5 is a partial view as seen from the rear of a golfer of said buckle component, in use; and FIG. 6 is a cross sectional view as seen along line 6—6 of FIG. 5.

As shown in FIG. 1, to distribute the weight of a golf bag 10 loaded with golf clubs, individually and collectively designated 12 there are provided two straps 14 and 16, connected, as is well known, at opposite ends to the golf bag 10 to configurate the straps into loops 18 and 20 which are each positioned over the two shoulders 22 and 24 of the golfer 26. In the wearing or in-use position of FIG. 1, there is a tendency of one or the other of the loops 18 and 20 to move in the directions 28 and slip off of a shoulder 22, 24.

To obviate this tendency, as well to provide other noteworthy benefits, the within inventive carrier, generally designated 30, as shown in FIGS. 2 and 3, includes a golf bag 32 having a first ring 34 attached to the upper end or collar 36 of the golf bag, and a second ring 38 attached to the golf bag body 40 just below the midpoint thereof, as at 42. First and second straps 14' and 16' have at opposite ends well known strap and buckle connecting means 48, and are each connected in spanning relation between the same two rings 34 and 38 so that each strap loop 44, 46 is angularly oriented in the directions 50 which results in a criss-crossing, as at the site 52 adjacent the approximate middle of the golfer's back 54.

To obviate the inadvertent slipping off of a strap 14', 16' use is made a strap movement-restraining buckle 56 in slipping off directions 58, while not restraining buckle movement in opposite directions 60 along the straps 14', 16', as is required in adjusting the angular positions of the straps 14', 16' in relation to the width of the golfer's shoulders 22, 24.

More particularly, the orientation of the strap loops 44 and 46 in the crossing directions 50 provides said criss-crossing site 52, at which the buckle 56 is operatively located and, significantly, is slidably disposed simultaneously on the strap loops 44 and 46 so as to partake of sliding movement along either one or simultaneously along both of the loops 44 and 46 which causes corresponding movement of the site 52 and in the size of the loops 44 and 46. Changes in the size of the loops 44 and 46 in practice has been found to correspondingly obviate strap corresponding outward movements 62 and 64 as might cause the loops 44 and 46 to slip off of the shoulders 22, 24 of the golfer 26.

In a preferred embodiment, as best understood from FIGS. 7–9, inclusive buckle 56 will be understood to be an injection molded plastic article of manufacture having a substantially rectangular body 66 provided with a first set of edges, individually and collectively designated 68 which bound aligned openings 70 to receive in threaded or projected relation therethrough in a direction 72 an end of strap loop 44 prior to its connection to ring 34. Buckle 56 is also provided with a second set of edges, again individually and collectively designated, but with the designation 74, which bound aligned openings 76 to receive in threaded or projected relation therethrough in a direction 78 an end of the other strap loop 46 prior to its connection to the same ring 34.

Under the weight of the golf clubs 12 and the golf bag 32, there is a tendency to impart a flat configuration to strap loop 46. The buckle openings 74 are provided with a curvalinear shape, as best shown in FIG. 5, which imparts a correspondingly curvalinear shape to the length portion of strap loop 46 threaded through the buckle. It has been found in practice that this difference in shapes results in a slight friction fit exerted upon threaded strap loop 46 which obviates inadvertent sliding movement thereof.

While the apparatus for the golf bag two-strap carrier, herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A golfer-carried golf bag comprising a first golf bag-supporting shoulder strap with opposite ends, connecting means at selected specified upper and lower locations for connecting an end of said first strap adjacent an upper end of a golf bag and a lower end adjacent a lower golf bag end, said connecting means locations being selected to orient said first strap in a loop configuration in spanning relation between said connecting means, a second golf bag-supporting shoulder strap with opposite ends, connecting means at said same specified upper and lower locations for connecting an end of said second strap adjacent the upper end of said golf bag and the lower end adjacent the lower golf bag end, said connecting means locations being selected to orient said second strap in a loop configuration opposite to that of said first strap, a strap-crossing site in a medial location of a back of a golfer at which said first and second straps cross and are in contact with each other, and operatively disposed at said strap-crossing site a one-piece buckle having a planar, substantially rectangular body delimited on opposite sides by first and second edges bounding therebetween first and second rectangular slots each parallel to a long dimension of said rectangular body, a length portion of said first strap having an operative position threaded in an angular direction through said first and second rectangular slots so as to have a portion thereof in overlying relation upon said body, said centrally located body delimited by third and fourth edges bounding therebetween third and fourth curvilinear slots wherein each of said first and second slots, defining an axis along the length thereof such that each said axis intersects each of said curvilinear slots a length portion of said second strap having an operative position threaded in a crossing angular direction through said third and fourth curvilinear slots so as to have a portion thereof in overlying relation to said portion of said first strap upon said body, whereby said second and first straps in said superposed relation upon said body are conjointly held against slippage by said curvilinear slots.

* * * * *